US006095659A

United States Patent [19]

Hsu

[11] Patent Number: 6,095,659

[45] Date of Patent: Aug. 1, 2000

[54] ELECTRIC TOOL STRUCTURE HAVING A LIGHT DEVICE

[75] Inventor: Hung-Ming Hsu, Taichung, Taiwan

[73] Assignee: Mobiletron Electronics Co., Ltd., Taichung Hsien, Taiwan

[21] Appl. No.: 09/275,960

[22] Filed: Mar. 25, 1999

[51] Int. Cl.[7] ..... B25B 23/18

[52] U.S. Cl. ..... 362/119; 362/89

[58] Field of Search ..... 362/89, 119, 120, 362/109

[56] References Cited

U.S. PATENT DOCUMENTS

| | | | |
|---|---|---|---|
| 2,310,166 | 2/1943 | Way | 362/119 |
| 5,412,546 | 5/1995 | Huang | 362/119 |
| 5,793,130 | 8/1998 | Anderson | 362/119 |
| 6,033,082 | 3/2000 | Lin | 362/120 |

*Primary Examiner*—Alan Cariaso
*Attorney, Agent, or Firm*—Rosenberg, Klein & Lee

[57] ABSTRACT

An electric tool structure having a lighting device, in particular an electric tool having a lighting device insertably provided near a bit or head portion of the electric tool body, includes a light shade having projection windows, a torsion adjusting knob insertably provided with light bulbs, a torsion adjusting unit disposed inside the torsion adjusting knob, a switch ring, a metal gear housing, a gear set disposed inside the metal gear housing, and a power tool body. The power tool body has a front end connected to the metal gear housing. First and second electric conductive plates of different polarities extend from a power source in an interior of the power tool body. The first electric conductive plate is in contact with a wall of the metal gear housing in a lapping manner. The second electric conductive plate contacts the wall of the metal gear housing. A first electrically conductive plate is insertably disposed in the wall of the metal gear housing. The switch ring is sleeved onto the metal gear housing, and has an inner wall provided with an electric conductive elastic plate that projects therefrom to urge against the first electrically conductive plate. The torsion adjusting unit in the torsion adjusting knob engages retainingly the wall of the metal gear housing. The torsion adjusting unit is provided with a second electrically conductive plate that is capable of contacting the first electrically conductive plate in a lapping manner, and that is connected to light bulb holders in the torsion adjusting knob. The light shade covers a front end of the torsion adjusting knob opposite to the metal gear housing such that the projection windows are aligned with the light bulbs. By turning the switch ring, the conductive elastic plate presses against the first electrically conductive plate to contact the second-electrically conductive plate to make the electrical connection so that the light bulbs can radiate light to illuminate a working zone.

3 Claims, 4 Drawing Sheets

ELECTRIC TOOL STRUCTURE HAVING A LIGHT DEVICE

BACKGROUND OF THE INVENTION (a) Field of the Invention

The present invention relates to an electric tool, and more particularly to an electric tool structure that is provided with an integral lighting device to facilitate operation in a dim or tight working environment.

(b) Description of the Prior Art

Conventional electric tools are generally not provided with any lighting means. In a dim working environment, the user has to rely solely upon the available light or use a separate lighting device, which is very inconvenient. The use of auxiliary lighting devices to improve the visibility in a dim working environment has the following drawbacks:

1. If the user has to use a separate lighting device, such a flashlight, in addition to the electric tool in performing a job, it is very inconvenient. Furthermore, in a working environment that is not very dim or small, if all the lights are turned on, it will be a waste of energy.
2. If the bit or head portion of the electric tool has to extend into a deep recess or gap to perform the job, the ambient light will not be able to reach the recess or gap to facilitate performance of the job.

It is therefore necessary to provide an electric tool provided with a lighting means to solve the problems of the prior art.

SUMMARY OF THE INVENTION

A primary object of the present invention is to provide an electric tool structure having a lighting device, in which a lighting device is mounted near a bit or head portion of an electric tool body to facilitate operation in a dim or tight working environment in a convenient. Besides, the lighting device is configured to illuminate only the working zone to help save electric power, and the operational functions of the electric tool will not be affected by the provision of the lighting device.

Another object of the present invention is to provide an electric tool structure having a lighting device, in which the light emitted by the lighting device is a narrow beam of light that can reach deep crevices or recesses to facilitate operation so as to eliminate the problems of the prior art.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
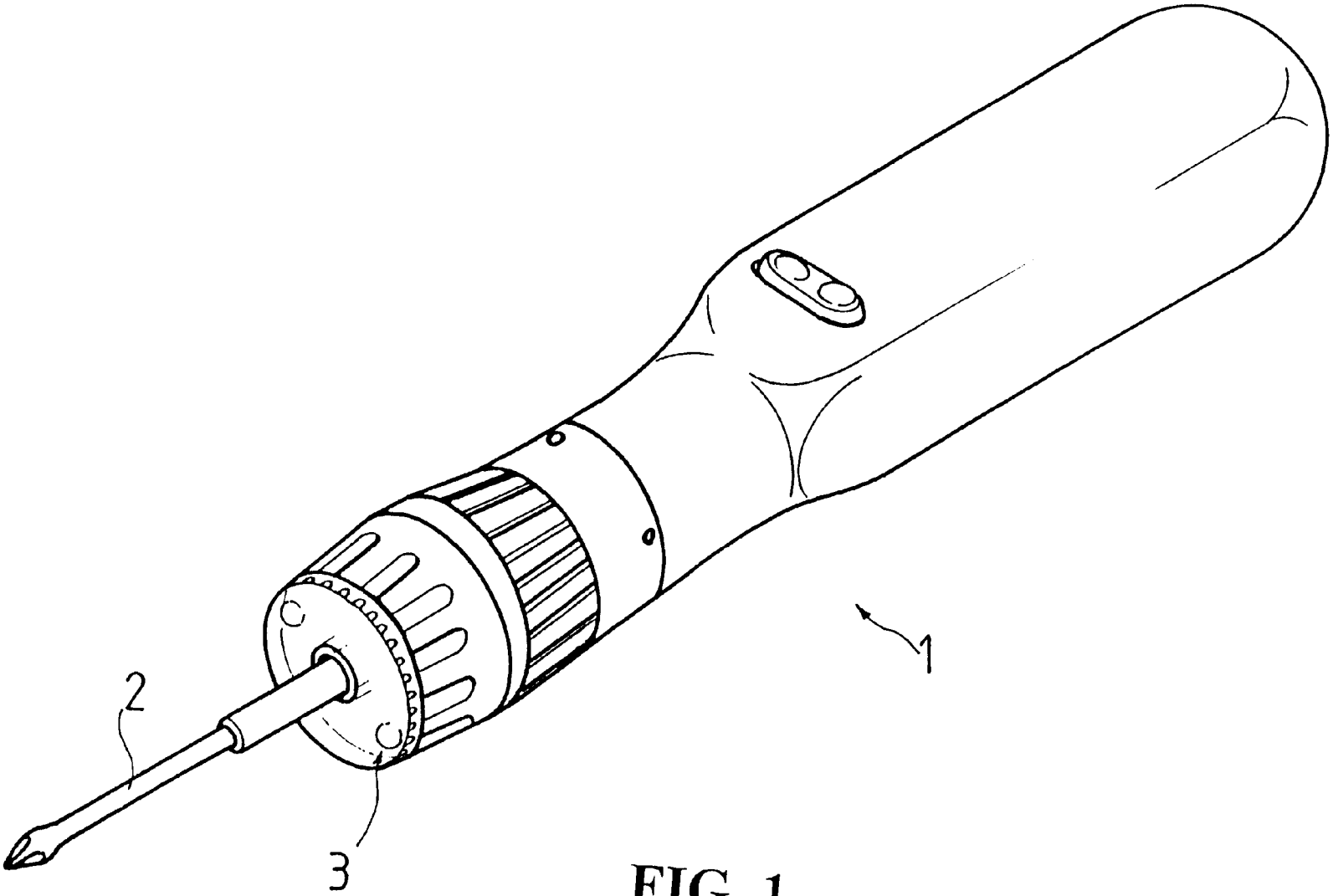
FIG. 1 is a perspective view of a preferred embodiment of an electric tool structure having a lighting device of the present invention.
Figure 2:
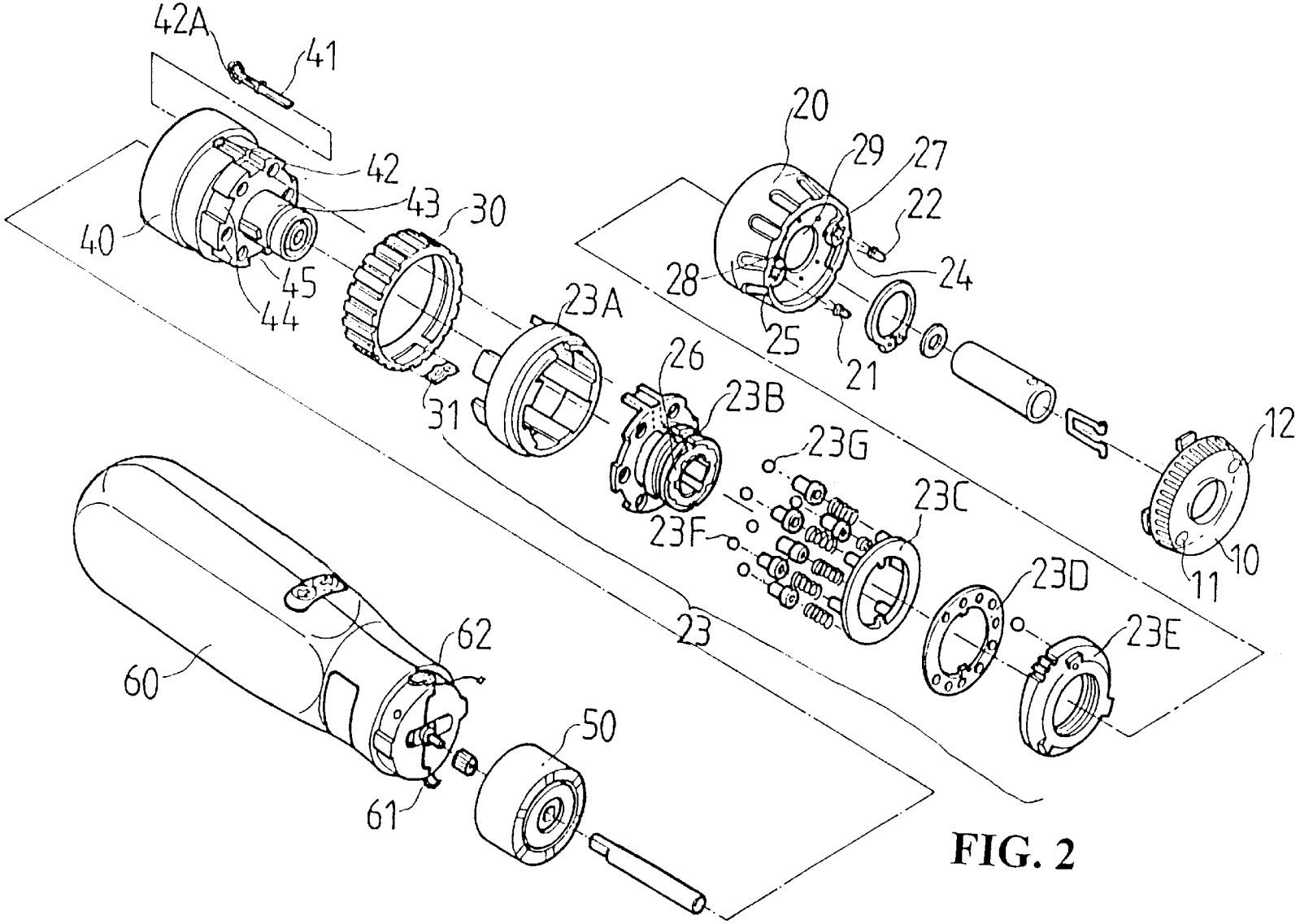
FIG. 2 is an exploded perspective view of the preferred embodiment.
Figure 3:
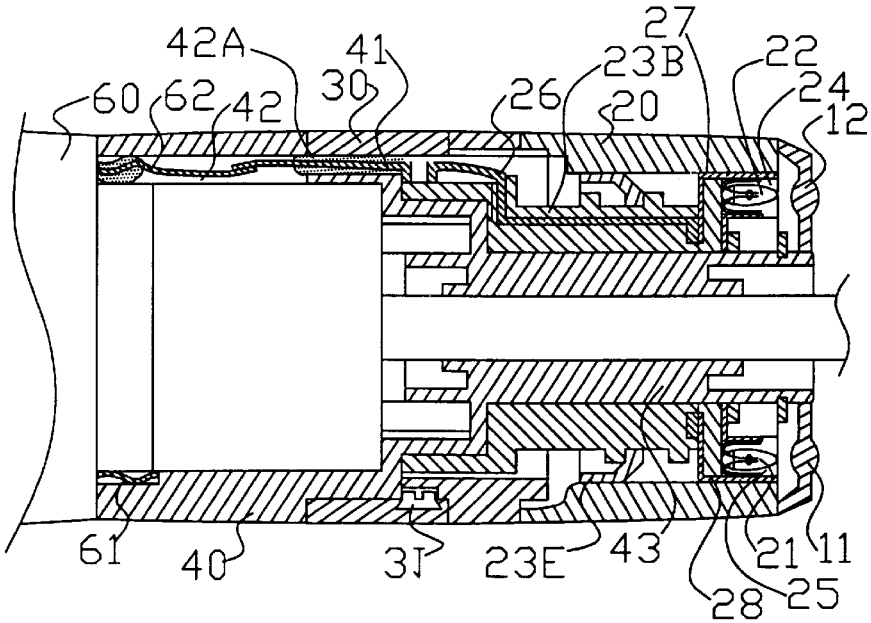
FIG. 3 is a sectional view of the preferred embodiment.

With reference to FIG. 1, a lighting device 3 is insertably provided on a body of an electric tool 1 at where the body is connected to a bit 2. Referring to FIGS. 2 and 3, the present invention is shown to include a light shade 10 having projection windows 11, 12, a torsion adjusting knob 20 insertably provided with light bulbs 21, 22, a torsion adjusting unit 23 disposed inside the torsion adjusting knob 20, a switch ring 30, a metal gear housing 40, a gear set 50 disposed inside the metal gear housing 40, and a power tool body 60. A front end of the power tool body 60 is connected to the metal gear housing 40. First and second electrically conductive plates 61, 62 of two different polarities (i.e., positive and negative electrodes) extend from a power source in an interior of the power tool body 60. The first electrically conductive plate 61 is in contact with a wall of the metal gear housing 40 in a lapping manner. The second electrically conductive plate 62 contacts the wall of the metal gear housing 40. A first electrically conductive plate 41 is insertably disposed in a gap 42 formed in the wall of the metal gear housing 40. Where the first electrically conductive plate 41 is in contact with the metal gear housing 40, it is wrapped in an insulating covering 42A to prevent electrical contact between the first electrically conductive plate 41 and the metal gear housing 40 to cause short circuit. The switch ring 30 is sleeved onto the metal gear housing 40, and has an inner wall provided with an electric conductive elastic plate 31 that projects therefrom. The switch ring 30 is turnable to cause the conductive elastic plate 31 to urge against the first electrically conductive plate 41. The metal gear housing 40 is fitted over a front end of the gear set 50, and is provided with a plurality of retaining grooves 44, 45, . . . . The metal gear housing 40 further has a tubular portion 43 projecting from a central portion thereof to engage retainingly the torsion adjusting unit 23 in the torsion adjusting knob 20. The structure of the torsion adjusting unit 23 is substantially the same as the locking unit in a conventional electric tool, and includes a connecting ring 23*a*, a threaded tubular seat 23*b*, a torsion pin ring 23C, a calibrated packing plate 23D, and a nut ring 23E. The torsion pin ring 23C has a plurality of balls 23F, 23G, . . . provided thereon. The balls are urged against by an elastic force to pass through the threaded tubular seat 23B and the metal gear housing 40 to abut the gear set 50. The torsion adjusting unit 23 differs from the conventional structure in that the threaded tubular seat 23*b* is provided with a second electrically conductive plate 26 that is capable of contacting the first electrically conductive plate 41 in a lapping manner, and that is connected to outer sides of light bulb holders 24, 25 in the torsion adjusting knob 20 via a negative conductive plate 14. A positive conductive plate 13 is fitted on the tubular portion 43 of the metal gear housing 40 to connect inner sides of the light bulb holders 24, 25 to the tubular portion 43. The nut ring 23E has an inner threaded wall that engages the threaded tubular seat 23B, with an outer rim retained in an inner wall of the torsion adjusting knob 20. The light bulbs 21, 22 each have a connecting pin passing through a corresponding fine hole 27, 28 beside the light bulb holders 24, 25 to contact the negative conductive plate 14, with the other connecting pin adhered to the positive conductive plate 13 to connect the portion of the tubular portion 43 that projects from a central through hole 29 of the torsion adjusting knob 20, thereby accomplishing a lighting circuit controllable by the switch ring 30. The light shade 10 is disposed on a front end of the torsion adjusting knob 20 opposite to the metal gear housing 40 such that the projection windows 11, 12 are aligned with the light bulbs 21, 22. The light shade 10 may be made from a transparent material, and the projecting windows 11, 12 can be configured to have an amplifying function to enhance the illuminating effect of the projected light.

Figure 4:
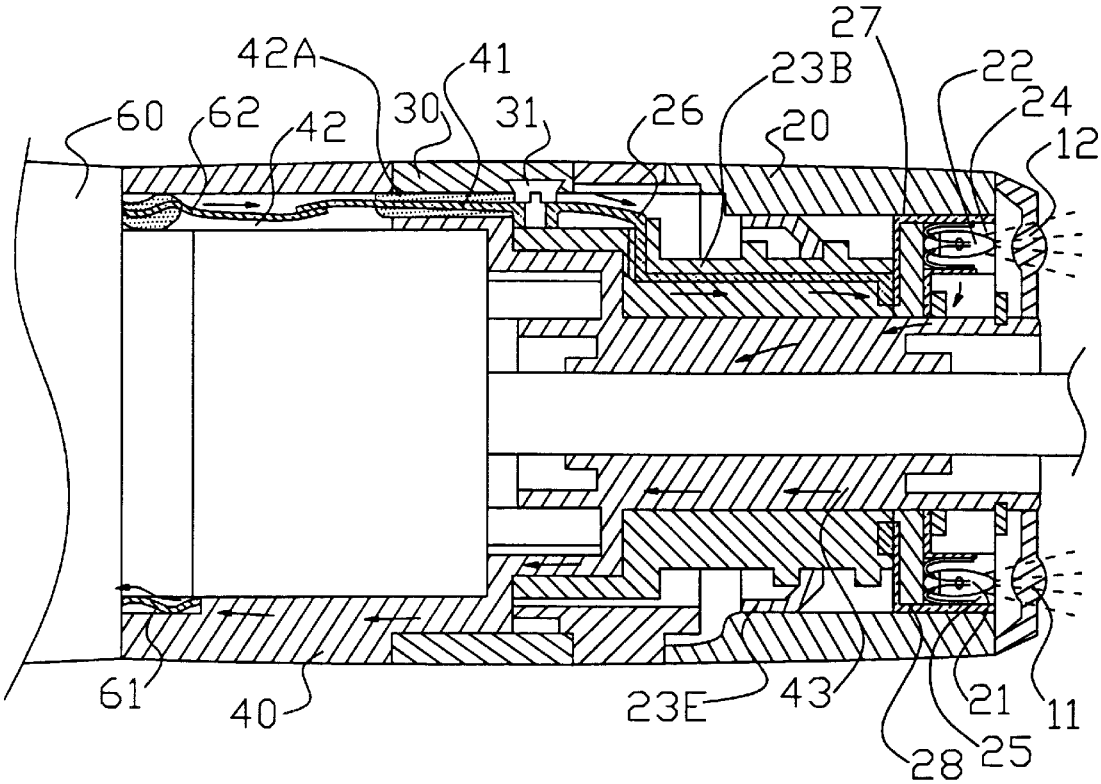
FIG. 4 is another sectional view of the preferred embodiment, illustrating operation thereof.
Figure 5:
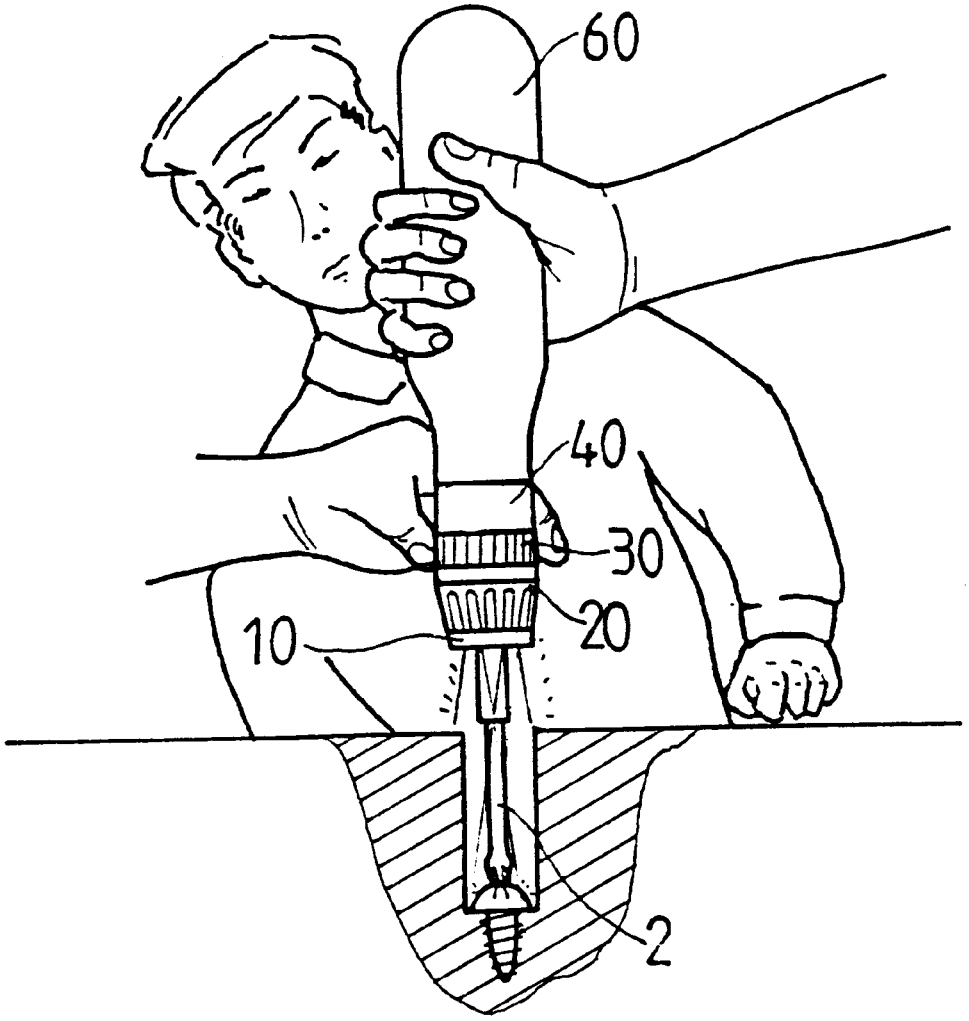
FIG. 5 is a schematic view illustrating operation of the present invention in a state of use.

Referring to FIG. 4, in use, the switch ring 30 is turned to cause the electric elastic plate 31 inside the ring to press against the first electrically conductive plate 41 of the metal gear housing 40 to contact the second electrically conductive plate 26 on the threaded tubular seat 23B to make the electrical connection, causing the light bulbs 21, 22 to radiate light that is projected through the projection windows 11, 12 to light up a working zone or a deep crevice, as shown in FIG. 5.

In view of the aforesaid, it can be appreciated that the present invention enables the user to work in a dim environment and to light up a narrow and tight working zone by the use of a lighting device incorporated in the electric tool. The problems of the prior art can therefore be eliminated.

Although the present invention has been illustrated and described with reference to the preferred embodiment thereof, it should be understood that it is in no way limited to the details of such embodiment but is capable of numerous modifications within the scope of the appended claims.

What is claimed is:

1. An electric tool structure having a lighting device, comprising:

a light shade having projection windows, a torsion adjusting knob insertably provided with light bulbs, a torsion adjusting unit disposed inside said torsion adjusting knob, a switch ring, a metal gear housing, a gear set disposed inside said metal gear housing, and a power tool body, said power tool body having a front end connected to said metal gear housing, first and second electric conductive plates of different polarities extending from a power source in an interior of said power tool body, said first electric conductive plate being in contact with a wall of said metal gear housing in a lapping manner, said second electric conductive plate contacting said wall of said metal gear housing, a first electrically conductive plate being insertably disposed in said wall of said metal gear housing, said switch ring being sleeved onto said metal gear housing, and having an inner wall provided with an electric conductive elastic plate that projects therefrom to urge against said first electrically conductive plate, said torsion adjusting unit in said torsion adjusting knob engaging retainingly said wall of said metal gear housing, said torsion adjusting unit being provided with a second electrically conductive plate that is capable of contacting said first electrically conductive plate in a lapping manner, and that is connected to light bulb holders in said torsion adjusting knob, said light shade covering a front end of said torsion adjusting knob opposite to said metal gear housing such that said projection windows are aligned with said light bulbs.

2. The electric tool structure having a lighting device as defined in claim 1, wherein said wall of said metal gear housing is formed with a gap for insertion of said first electrically conductive plate, that portion of said first electrically conductive plate that is in contact with said metal gear housing being wrapped in an insulating covering to prevent electrical contact between said first electrically conductive plate and said metal gear housing to avoid short circuit.

3. The electric tool structure having a lighting device as defined in claim 1, wherein said light shade is made of a transparent material, and said projection windows are configured to have a magnifying function to achieve an enhanced lighting effect.

* * * * *